US009224337B2

(12) United States Patent
Bae et al.

(10) Patent No.: US 9,224,337 B2
(45) Date of Patent: Dec. 29, 2015

(54) COMPENSATION OF THRESHOLD VOLTAGE IN DRIVING TRANSISTOR OF ORGANIC LIGHT EMITTING DIODE DISPLAY DEVICE

(71) Applicant: LG Display Co., Ltd., Seoul (KR)

(72) Inventors: Nayoung Bae, Busan (KR); Joongsun Yoon, Paju-si (KR); Minjae Shin, Seoul (KR)

(73) Assignee: LG Display Co., Ltd., Seoul (KR)

( * ) Notice: Subject to any disclaimer, the term of this patent is extended or adjusted under 35 U.S.C. 154(b) by 54 days.

(21) Appl. No.: 13/865,018

(22) Filed: Apr. 17, 2013

(65) Prior Publication Data

US 2014/0035799 A1 Feb. 6, 2014

(30) Foreign Application Priority Data

Jul. 31, 2012 (KR) ..... 10-2012-0083847

(51) Int. Cl.
*G09G 3/32* (2006.01)

(52) U.S. Cl.
CPC ..... *G09G 3/3266* (2013.01); *G09G 3/3233* (2013.01); *G09G 2300/0819* (2013.01); *G09G 2300/0852* (2013.01); *G09G 2300/0861* (2013.01); *G09G 2310/0251* (2013.01); *G09G 2310/0262* (2013.01); *G09G 2320/043* (2013.01)

(58) Field of Classification Search
CPC ..... G09G 3/3208–3/3291
See application file for complete search history.

(56) References Cited

U.S. PATENT DOCUMENTS

2011/0193855 A1* 8/2011 Han ..... 345/214
2012/0200611 A1* 8/2012 Matsui et al. ..... 345/690
2012/0218251 A1* 8/2012 Mitomi et al. ..... 345/212

FOREIGN PATENT DOCUMENTS

CN 101866614 A 10/2010
CN 102047312 A 5/2011

OTHER PUBLICATIONS

Chinese First Office Action, Chinese Application No. 201310170738.8, Apr. 29, 2015, 14 pages.

* cited by examiner

*Primary Examiner* — Sanghyuk Park
(74) *Attorney, Agent, or Firm* — Fenwick & West LLP

(57) ABSTRACT

The organic light emitting diode display device comprising a display panel a plurality of pixels arranged in a matrix form, each of the pixels comprising: a driving TFT including a gate electrode coupled to a first node, a source electrode coupled to a second node, and a drain electrode coupled to a high-potential voltage line; an organic light emitting diode including an anode coupled to the second node and a cathode coupled to a low-potential voltage line; a first TFT supplying a data voltage to the first node in response to a scan signal; a initialization control circuit initializing the first node to a first reference voltage and the second node or the third node to a second reference voltage in response to a initialization signal and an emission signal; and capacitors.

15 Claims, 24 Drawing Sheets

FIG. 4

| Period | N1 | N2 | N3 |
|---|---|---|---|
| t1 | REF1 | REF2 | REF2 |
| t2 | A | A - Vth | A - Vth |
| t3 | DATA | A - Vth | A - Vth - (A - DATA) |
| t4 | DATAxC2+C1(Vth+Voled_anode) / (C1+C2) | Voled_anode | Voled_anode |

FIG. 7

| Period | N1 | N2 | N3 |
|---|---|---|---|
| t1 | REF1 | REF2 | REF2 |
| t2 | A | A - Vth | A - Vth |
| t3 | DATA | A - Vth | A - Vth - (A - DATA) |
| t4 | DATAxC2+C1(Vth+Voled_anode) / (C1+C2) | Voled_anode | Voled_anode |

FIG. 10

| Period | N1 | N2 | N3 |
|---|---|---|---|
| t1 | REF1 | REF2 | REF2 |
| t2 | A | A - Vth | A - Vth |
| t3 | DATA | A - Vth | A - Vth<br>- (A - DATA) x C' |
| t4 | DATA+(Voled_anode<br>- [A' - Vth - (A' - DATA) x C']) | Voled_anode | Voled_anode |

COMPENSATION OF THRESHOLD VOLTAGE IN DRIVING TRANSISTOR OF ORGANIC LIGHT EMITTING DIODE DISPLAY DEVICE

CROSS-REFERENCE TO RELATED APPLICATION

This application claims priority under 35 U.S.C. §119(a) of Korean Patent Application No. 10-2012-0083847, filed on Jul. 31, 2012, which is incorporated by reference in its entirety.

BACKGROUND

1. Technical Field

This document relates to an organic light emitting diode display device compensating the threshold voltage of a driving thin film transistor (TFT).

2. Discussion of the Related Art

With the development of information society, the demand for various types of display devices for displaying an image is increasing. Various flat panel displays such as a liquid crystal display (LCD), a plasma display panel (PDP), and an organic light emitting diode (OLED) have been widely used in recent years. Among the flat panel displays, the organic light emitting diode display device are driven at a low voltage, are thin, have a wide viewing angle and a quick response speed.

A display panel of the OLED display comprises a plurality of pixels arranged in a matrix form. Each of the pixels comprises a scan thin film transistor (TFT) for supplying a data voltage of a data line in response to a scan signal of a scan line and a driving TFT for adjusting the amount of the current supplied to an organic light emitting diode in accordance with a data voltage supplied to a gate electrode. The drain-source current Ids of the driving TFT supplied to the organic light emitting diode can be expressed by following equation:

$$I_{ds}=k'\cdot(V_{gs}-V_{th})^2 \quad (1)$$

where k' represents a proportionality coefficient determined by the structure and physical properties of the driving TFT, Vgs represents the gate-source voltage of the driving TFT, and Vth represents the threshold voltage of the driving TFT.

The drain-source current Ids of the driving TFT depends upon the threshold voltage Vth of the driving TFT. However, the threshold voltage Vth of the driving TFT of each of the pixels may have a different value due to a shift in the threshold voltage Vth caused by degradation of the driving TFT. Hence, the current Ids supplied to the organic light emitting diode differs from pixel to pixel even if the same data voltage is supplied to each of the pixels. Accordingly, the luminance of light emitted from the organic light emitting diode of each of the pixels may differ even if the same data voltage is supplied to each of the pixels. To solve this problem, various types of pixel structures for compensating the threshold voltage Vth of the driving TFT have been proposed.

FIG. 1 is a circuit diagram showing a part of a conventional diode-connected threshold voltage compensation pixel structure. FIG. 1 depicts a driving TFT DT supplying the current to an organic light emitting diode and a sensing TFT ST coupled between a gate node Ng and drain node Nd of the driving TFT DT. The sensing TFT ST allows for a connection between the gate node Ng and drain node Nd of the driving TFT DT during a threshold voltage sensing period of the driving TFT DT so that the driving TFT DT functions as a diode. In FIG. 1, the driving TFT DT and the sensing TFT ST are illustrated as N-type MOSFET (Metal Oxide Semiconductor Field Effect Transistors).

Referring to FIG. 1, the gate node Ng and the drain node Nd are coupled during the threshold voltage sensing period in which the sensing TFT ST is turned on, thereby the gate node Ng and the drain node Nd are in a floating state at substantially the same potential. The floating state refers to a state in which no voltage is supplied to a node, so the node on the floating state affects a voltage change of an adjacent node easily. If a voltage difference Vgs between the gate node Ng and a source node Ns is greater than a threshold voltage, the driving TFT DT forms a current path until the voltage difference Vgs between the gate node Ng and the source node Ns reaches the threshold voltage Vth of the driving TFT DT, and as a result, the voltage of the gate node Ng and the voltage of the drain node Nd are lowered. However, if the threshold voltage Vth of the driving TFT DT is shifted to a negative voltage, the voltage difference Vgs between the gate node Ng and the source node Ns cannot reach the threshold voltage Vth of the driving TFT DT, even if the voltage at the gate node Ng goes down to the voltage at the source node Ns, because the threshold voltage Vth of the driving TFT DT is lower than 0 V. Consequently, if the threshold voltage Vth of the driving TFT DT is shifted to a negative voltage, it is impossible to sense the threshold voltage Vth of the driving TFT DT correctly. A negative shift refers to shifting the threshold voltage Vth of the driving TFT DT to a voltage lower than 0 V when the driving TFT DT is implemented as an N-type MOSFET. The negative shift usually occurs when a semiconductor layer of the driving TFT DT is formed of an oxide.

SUMMARY

Embodiments relate to an organic light emitting diode display device including a plurality of pixels arranged in a matrix form. Each of the pixels includes a driving thin film transistor (TFT), an organic light emitting diode, a first TFT, an initialization control circuit and a first capacitor. The driving TFT includes a gate electrode coupled to a first node, a source electrode coupled to a second node, and a drain electrode coupled to a high-potential voltage line. The organic light emitting diode is placed between the second node and a low-potential voltage line. The first TFT is configured to connect a data line to the first node during a data voltage supply period of a frame period. The initialization control circuit is coupled between the first node and a first reference voltage line supplying a first reference voltage and is connected to a second node, a third node and a second reference voltage line supplying a second reference voltage. The initialization control circuit is configured to initialize the first node to the first reference voltage, and the second and third nodes are initialized to a second reference voltage during an initialization period of the frame period preceding the data voltage supply period. The first capacitor is coupled between the first node and the third node. The first capacitor is configured to store a voltage difference between the first node and the third node during the initialization period, and change a voltage level of the first node based on a voltage level of the third node in a threshold voltage sensing period between the initialization period and the data voltage supply period.

The features and advantages described in this summary and the following detailed description are not intended to be limiting. Many additional features and advantages will be apparent to one of ordinary skill in the art in view of the drawings, specification and claims.

BRIEF DESCRIPTION OF THE DRAWINGS

FIG. 4 is a table showing changes in the voltages of nodes of a pixel according to a first exemplary embodiment.

FIG. 7 is a table showing changes in the voltages of nodes of a pixel according to a second exemplary embodiment.

FIG. 10 is a table showing changes in the voltages of nodes of a pixel according to a third exemplary embodiment.

DETAILED DESCRIPTION

Figure 1:
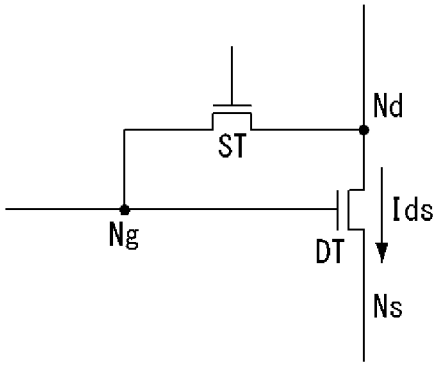
FIG. 1 (PRIOR ART)
FIG. 1 is a circuit diagram showing a part of a conventional diode-connected threshold voltage compensation pixel structure.

Embodiments will be described more fully hereinafter with reference to the accompanying drawings. Like reference numerals designate like elements throughout the specification. In the following description, if it is decided that the detailed description of known function or configuration related to the embodiments make the subject matter unclear, the detailed description is omitted.

A pixel of an organic light emitting diode display device according to an exemplary embodiment may internally compensate the threshold voltage of a driving TFT. Internal compensation refers to sensing and compensating the threshold voltage of the driving TFT in real time within the pixel.

Figure 2:
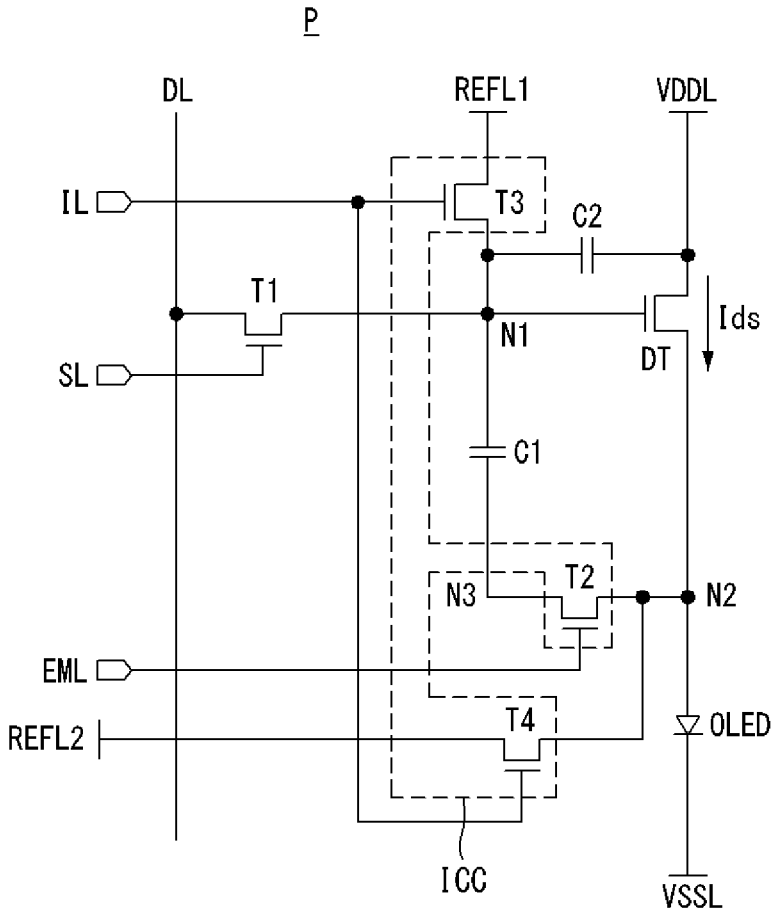
FIG. 2 is an equivalent circuit diagram of a pixel according to a first exemplary embodiment.

FIG. 2 is a circuit diagram of a pixel according to a first exemplary embodiment. Referring to FIG. 2, the pixel P according to the first exemplary embodiment comprises a driving TFT (thin film transistor) DT, an organic light emitting diode (OLED), a control circuit, and capacitors.

The driving TFT DT adjusts the amount of drain-source current Ids according to the level of a voltage applied to a gate electrode. The gate electrode of the driving TFT DT is coupled to a first node N1, a source electrode thereof is coupled to a second node N2, and a drain electrode thereof is coupled to a high-potential voltage line VDDL supplying a high-potential voltage VDD.

An anode of the organic light emitting diode is coupled to the second node N2, a cathode thereof is coupled to a low-potential voltage line VSSL supplying a low-potential voltage VSS. The organic light emitting diode OLED emits light depending on the drain-source current Ids of the driving TFT DT.

The control circuit comprises a first TFT T1 and an initialization control circuit ICC. The first TFT T1 is a scan TFT which supplies a data voltage DATA of a data line DL to the first node N1 in response to a scan signal SCAN supplied through a scan line SL. A gate electrode of the first TFT T1 is coupled to the scan line SL, a source electrode thereof is coupled to the first node N1, and a drain electrode thereof is coupled to the data line DL.

The initialization control circuit (ICC) includes second to fourth TFT T2 through T4. The second TFT T2 is a node connection control TFT which controls to connect the second node N2 to the third node N3 in response to an emission signal EM supplied through an emission line EML. A gate electrode of the second TFT T2 is coupled to the emission line EML, a source electrode thereof is coupled to the third node N3, and a drain electrode thereof is coupled to the second node N2. The third TFT T3 is a first initialization TFT which initializes the first node N1 to a first reference voltage REF1 supplied through a first reference voltage line REFL1 in response to an initialization signal INI supplied through an initialization line IL. A gate electrode of the third TFT T3 is coupled to the initialization line IL, a source electrode thereof is coupled to the first reference voltage line REFL1, and a drain electrode thereof is the first node N1. The fourth TFT T4 is a second initialization TFT which initializes the second node N2 to a second reference voltage REF2 supplied through a second reference voltage line REFL2 in response to the initialization signal INI. A gate electrode of the third TFT T4 is coupled to the initialization line IL, a source electrode thereof is coupled to the second reference voltage line REFL2, and a drain electrode thereof is the second node N2.

The first capacitor C1 is coupled between the first node N1 and the third node N3. The first capacitor C1 stores a differential voltage between a voltage at the first node N1 and a voltage at the third node N3. The second capacitor C2 is coupled between the first node N1 and the high-potential voltage line VDDL. In this case, the second capacitor C2 stores a differential voltage between a voltage at the first node N1 and the high potential voltage VDD. Or, the second capacitor C2 may be coupled between the first node N1 and the first reference voltage line REFL1. In this case, the second capacitor C2 stores a differential voltage between the first reference voltage REF1. Alternatively, the second capacitor C2 may be coupled between the first node N1 and the second reference voltage line REFL2. In this case, the second capacitor C2 stores a differential voltage between a voltage at the first node N1 and the second reference voltage REF2.

The first node N1 is a contact point at which the gate electrode of the driving TFT DT, the source electrode of the first TFT T1, the drain electrode of the third TFT T3, one electrode of the first capacitor C1, and one electrode of the second capacitor C2 are coupled. The second node N2 is a contact point at which the source electrode of the driving TFT DT, the anode of the organic light emitting diode, the drain electrode of the second TFT T2, and the drain electrode of the fourth TFT T4 are coupled. The third node N3 is a contact point at which the source electrode of the second TFT T2 and the other electrode of the first capacitor C1 are coupled.

Semiconductor layers of the first to fourth TFTs T1, T2, T3, and T4 and the driving TFT DT have been described as being formed of an oxide semiconductor. However, the embodiments are not limited thereto, and the semiconductor layers of the first to fourth TFTs T1, T2, T3, and T4 and the driving TFT DT may be formed of either a-Si or Poly-Si. Also, the exemplary embodiment has been described with respect to an example in which the first to fourth TFTs T1, T2, T3, and T4 and the driving TFT DT are implemented as N-type MOSFETs (Metal Oxide Semiconductor Field Effect Transistors). However, the present invention is not limited thereto, but the first to fourth TFTs T1, T2, T3, and T4 and the driving TFT DT are implemented as P-type MOSFETs.

After consideration of the characteristics of the driving TFT DT and the characteristics of the organic light emitting diode OLED, the high-potential voltage source is set to supply the high-potential voltage VDD through the high-potential voltage line VDDL, and the low-potential voltage source is set to supply the low-potential voltage VSS through the low-potential voltage line VSSL. For example, the high-potential voltage VDD may be set to approximately 20V, the low-potential voltage VSS may be set to approximately 0V. Also, the first reference voltage source is set to supply the first reference voltage REF1 through the first reference voltage line REFL1, and the second reference voltage source is set to supply the second reference voltage REF2 through the second reference voltage line REFL2. The second reference voltage REF2 is lower than a difference voltage between the first reference voltage REF1 and the threshold voltage Vth of the driving TFT DT to sense the threshold voltage Vth of the driving TFT DT.

Figure 3:
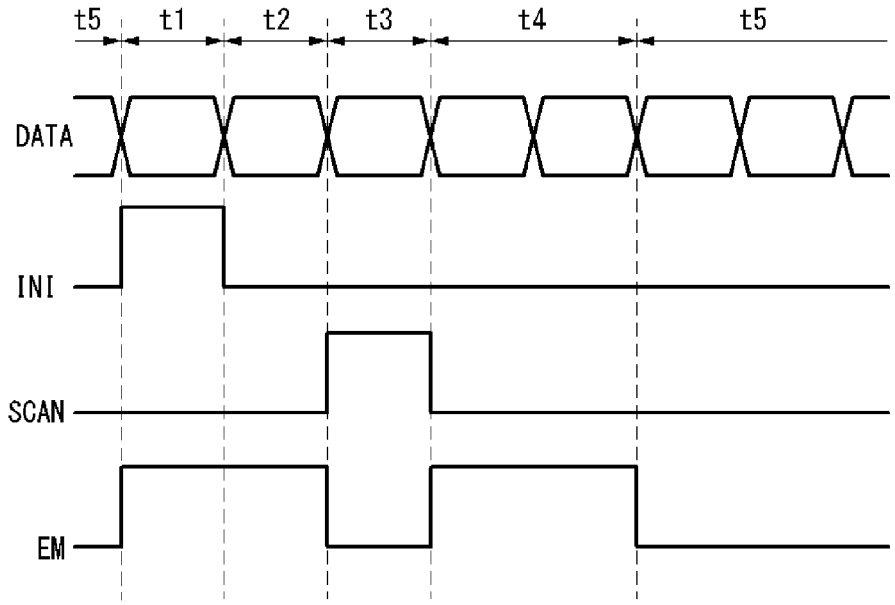
FIG. 3 is a waveform diagram showing signals which are input into a pixel according to an exemplary embodiment.

FIG. 3 is a waveform diagram showing signals received at a pixel according to an exemplary embodiment. FIG. 3 depicts an initialization signal INI supplied to an initialization line IL, a scan signal SCAN supplied to a scan line SL, and an emission signal EM supplied to an emission line EML. Also, FIG. 3 depicts a data voltage DATA supplied to a data line DL.

With reference to FIG. 3, the initialization signal INI, the scan signal SCAN, and the emission signal EM are signals for controlling first to fourth TFTs T1, T2, T3, and T4. Each of the initialization signal INI, the scan signal SCAN, and the emission signal EM is generated as a cycle of one frame period. Each of the initialization signal INI, the scan signal SCAN, and the emission signal EM swings between a first logic level voltage and a second logic level voltage. For example, the first logic level voltage is implemented as a gate high voltage VGH and the second logic level voltage is implemented as a gate low voltage VGL as shown in FIG. 3. The gate high voltage VGH is set to approximately 14V to 20V, and the gate low voltage VGL is set to approximately −5V to −12V.

One frame period is divided into first to fifth periods t1, t2, t3, t4, and t5. A first period t1 is an initialization period that initializes first to third nodes N1, N2, and N3. A second period t2 is a threshold voltage sensing period that senses a threshold voltage Vth of a driving TFT DT. A third period t3 is a data voltage supply period that supplies a data voltage DATA to a first node N1. A fourth period t4 and a fifth period t5 are an emission period that emits an organic light emitting diode OLED depending on the drain-source current Ids of the driving TFT DT.

The initialization signal INI and the emission signal EM are generated as the gate high voltage VGH, and the scan signal SCAN is generated as the gate low voltage VGL during the first period t1. The emission signal EM is generated as the gate high voltage VGH, and the scan signal SCAN and the emission signal EM are generated as the gate low voltage VGL during the second period t2. The scan signal SCAN is generated as the gate high voltage VGH, and the initialization signal INI and the emission signal EM are generated as the gate low voltage VGL during the third period t3. The emission signal EM is generated as the gate high voltage VGH, and the initialization signal INI and the scan signal SCAN are generated as the gate low voltage VGL during the fourth period t4. The initialization signal INI, the scan signal SCAN, and the emission signal EM are generated as the gate low voltage VGL during the fifth period t5.

The data voltage DATA is generated every horizontal period 1H. In the embodiment of FIG. 3, the third period t3 that supplies the data voltage DATA to the first node N1 is generated as one horizontal period 1H. However, other arrangements may be used in other embodiments. That is, the first to fourth periods t1, t2, t3, and t4 are several horizontal periods or dozens of horizontal periods for improving a picture quality of each pixel. Meanwhile, one horizontal period refers to one line scanning period in which data voltages are supplied to pixels arranged in one horizontal line of the display panel.

FIG. 4 is a table showing changes in the voltages of nodes of a pixel according to a first exemplary embodiment. FIGS. 5A through 5E are a circuit diagram of a pixel according to a first exemplary embodiment during first to fifth periods. An operation method of the pixel P will be described in the below with reference to FIGS. 3, 4, and 5A to 5E.

First, during the first period t1, the scan signal SCAN having the gate low voltage VGL is supplied through the scan line SL, and the initialization signal INI having the gate high voltage VGH is supplied through the initialization line IL as shown in FIG. 3. Also, during the first period t1, the emission signal EM having the gate high voltage VGH is supplied through the emission line EML as shown in FIG. 3.

Figure 5A:
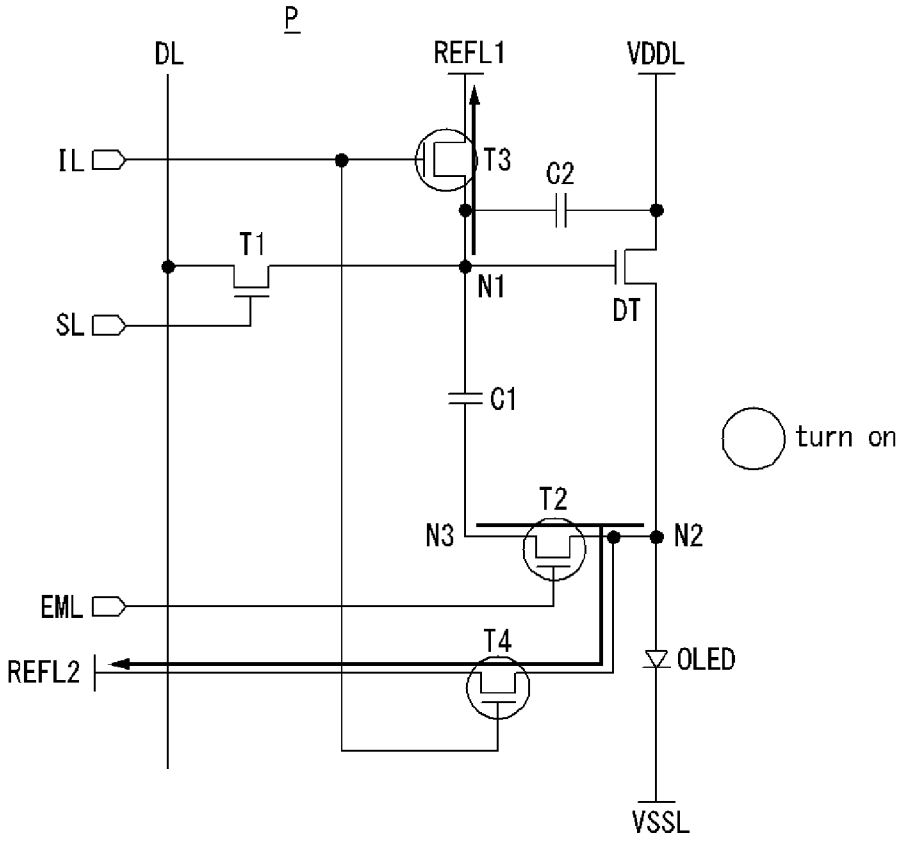
FIGS. 5A to 5E are circuit diagrams of a pixel according to a first exemplary embodiment during first to fifth periods.

With reference to FIG. 5A, the first TFT T1 is turned off by the scan signal SCAN having the gate low voltage VGL. The second TFT T2 is turned on in response to the emission signal EM having the gate high voltage VGH. Therefore, the second node N2 is coupled to the third node N3. The third TFT T3 is turned on in response to the initialization signal INI having the gate high voltage VGH. Therefore, the first node N1 is coupled to the first reference 6 voltage line REFL1. The fourth TFT T4 is turned on in response to the initialization signal INI having the gate high voltage VGH. Therefore, the second node N2 is coupled to the second reference voltage line REF2.

Finally, the voltage of the first node N1 is initialized to the first reference voltage REF1 since the third TFT T3 is turned on. The voltage of the second node N2 is initialized to the second reference voltage REF2 since the fourth TFT T4 is turned on. The voltage of the third node N3 is initialized to the second reference voltage REF2 since the second TFT T2 is turned on.

Second, during the second period t2, the scan signal SCAN having the gate low voltage VGL is supplied through the scan line SL, and the initialization signal INI having the gate low voltage VGL is supplied through the initialization line IL as shown in FIG. 3. Also, during the second period t2, the emission signal EM having the gate high voltage VGH is supplied through the emission line EML as shown in FIG. 3.

Figure 5B:
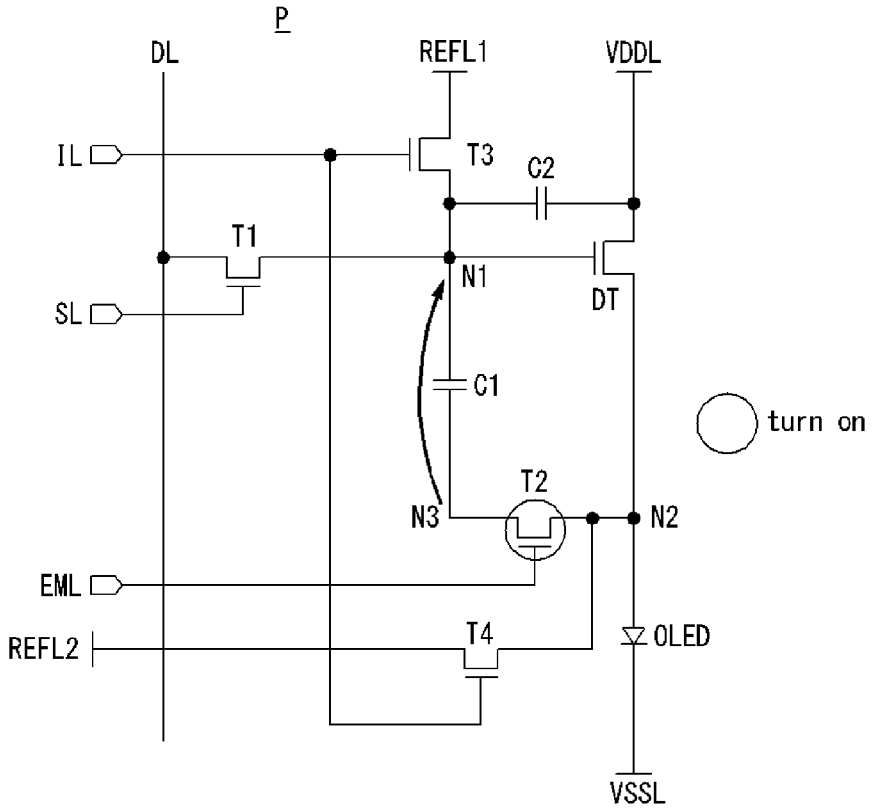

With reference to FIG. 5B, the first TFT T1 is turned off by the scan signal SCAN having the gate low voltage VGL. The second TFT T2 is turned on in response to the emission signal EM having the gate high voltage VGH. Therefore, the second node N2 is coupled to the third node N3. The third TFT T3 and the fourth TFT T4 are turned off by the initialization signal INI having the gate low voltage VGL. Therefore, each of the second node N2 and the third node N3 is no longer coupled to the second reference voltage line REF2. Meanwhile, the second node N2 and the third node N3 have substantially the same potential since the second TFT T2 is turned on.

Because the voltage difference Vgs between the gate and source electrodes of the driving TFT DT is greater than the threshold voltage Vth, the driving TFT DT forms a current path until the voltage difference Vgs between the gate and source electrodes reaches the threshold voltage Vth. Accordingly, the voltage of the second node N2 rises up. Also, the voltage of the third node N3 rises up since the second node N2 is coupled to the third node N3. Meanwhile, the voltage change of the third node N3 is applied to the first node N1 by the cap boosting of the first capacitor C1. If the voltage of the first node N1 which the voltage change of the third node N3 is applied to is "A" voltage, the voltage of the second node N2 rises up to a differential voltage A−Vth between the voltage A of the first node N1 and the threshold voltage Vth of the driving TFT DT. Also, the voltage of the third node N3 rises up to a differential voltage A−Vth between the voltage A of the first node N1 and the threshold voltage Vth of the driving TFT DT because the second node N2 is coupled to the third node N3. "A" voltage may be "REF1+α". Finally, the threshold voltage Vth of the driving TFT DT may be stored to the first capacitor C1 during the second period t2.

Third, during the third period t3, the scan signal SCAN having the gate high voltage VGH is supplied through the scan line SL, and the initialization signal INI having the gate low voltage VGL is supplied through the initialization line IL as shown in FIG. 3. Also, during the third period t3, the emission signal EM having the gate low voltage VGL is supplied through the emission line EML as shown in FIG. 3.

Figure 5C:
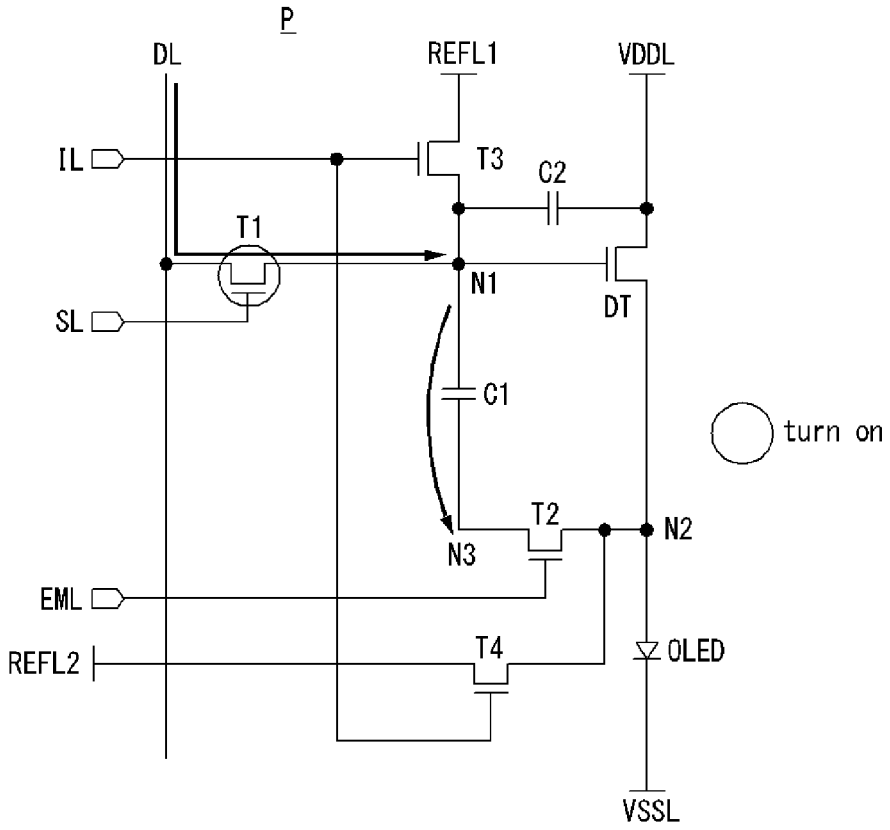

With reference to FIG. 5C, the first TFT T1 is turned on in response to the scan signal SCAN having the gate high voltage VGH. Therefore, the first node N1 is coupled to the data line DL. The second TFT T2 is turned off by the emission signal EM having the gate low voltage VGL. Therefore, the second node N2 is no longer coupled to the third node N3. The third TFT T3 and the fourth TFT T4 are turned off by the initialization signal INI having the gate low voltage VGL. Therefore, each of the second node N2 and the third node N3 is not coupled to the second reference voltage line REF2. Meanwhile, the data voltage DATA of the data line is supplied to the first node N1 since the first TFT T1 is turned on. The third node N3 is on the floating state since the second TFT T2 is turned off. The floating state refers to a state on which no voltage is supplied to a node, so the node on the floating state affects voltage change of an adjacent node easily.

The voltage change of the first node N1 is applied to the third node N3 since the third node N3 is on the floating state during the third period t3. Therefore, "A−DATA" corresponding to the voltage change of the first node N1 is applied to the third node N3, thus the voltage of the third node is changed to "A−Vth−(A−DATA)", that is "DATA−Vth".

Fourth, during the fourth period t4, the scan signal SCAN having the gate low voltage VGL is supplied through the scan line SL, and the initialization signal INI having the gate low voltage VGL is supplied through the initialization line IL as shown in FIG. 3. Also, during the fourth period t4, the emission signal EM having the gate high voltage VGH is supplied through the emission line EML as shown in FIG. 3.

Figure 5D:
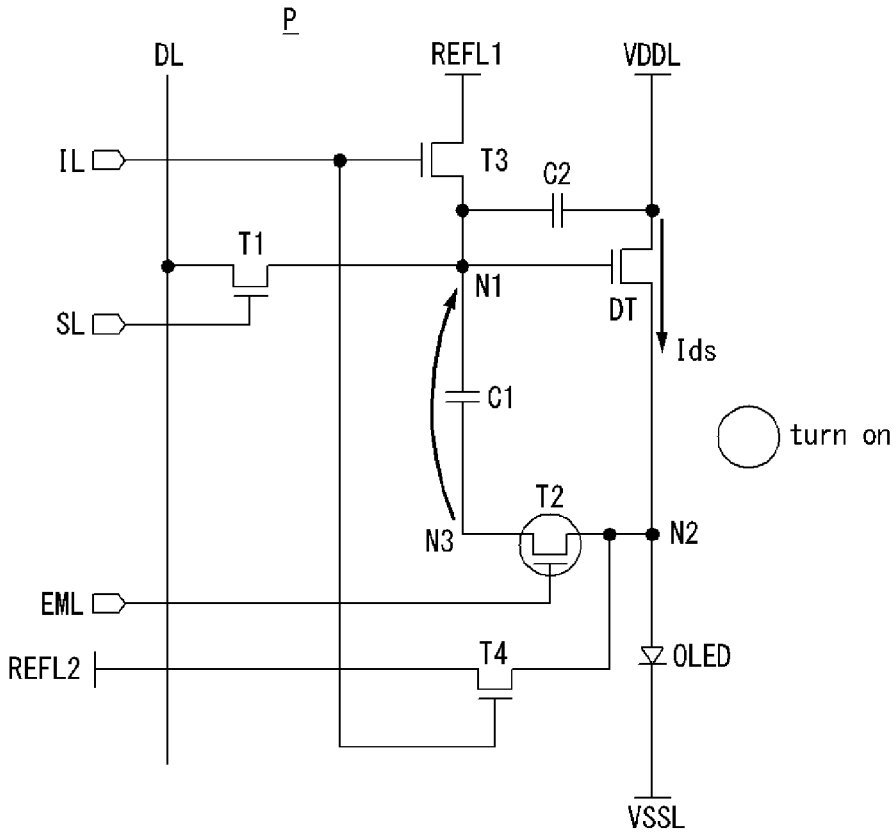

With reference to FIG. 5D, the first TFT T1 is turned off by the scan signal SCAN having the gate low voltage VGL. Therefore, the first node N1 is no longer coupled to the data line DL. The second TFT T2 is turned on in response to the emission signal EM having the gate high voltage VGH. Therefore, the second node N2 is coupled to the third node N3. The third TFT T3 and the fourth TFT T4 are turned off by the initialization signal INI having the gate low voltage VGL. Therefore, each of the second node N2 and the third node N3 is not coupled to the second reference voltage line REF2. Meanwhile, the first node N1 is on the floating state since the first TFT T1 and the third TFT T3 are turned off. The second node N2 and the third node N3 are at substantially the same potential since the second TFT T2 is turned on.

As shown in FIG. 4, the voltage of the second node N2 is changed to "Voled_anode" due to the drain-source current Ids of the driving TFT DT according to the voltage of the first node N1. Also, the voltage of the third node N3 is changed to "Voled_anode" because the second node N2 is coupled to the third node N3 since the second TFT T2 is turned on.

The voltage change of the third node N3 is applied to the first node N1 by the first capacitor C1 because the first node N1 is on the floating state during the fourth period t4. Therefore, the voltage change of the third node N3, "DATA−Vth-Voled_anode" is applied to the first node N1. However, the first node N1 is coupled between the first and second capacitors CA1 and CA2 coupled in series. Hence, the voltage change is applied in the ratio "C'" as expressed in following equation:

$$C' = \frac{CA1}{CA1 + CA2} \tag{2}$$

where CA1 represents the capacitance of the first capacitor C1, and CA2 represents the capacitance of the second capacitor C2. As a consequence, "C'(DATA−Vth-Voled_anode)" is applied to the first node N1, and thus the voltage of the first node N1 is changed to "DATA−C'(DATA−Vth−Voled_anode)". Meanwhile, the changed voltage of the first node N1 is expressed in following equation with CA1 and CA2:

$$\frac{\mathrm{DATA} \times CA2 + CA1(Vth + Voledanode)}{CA1 + CA2} \tag{3}$$

Also, the drain-source current Ids of the driving TFT DT supplied to the organic light emitting diode OLED is expressed by the following equation:

$$I_{ds} = k' \cdot (V_{gs} - V_{th})^2 \tag{4}$$

where k' represents a proportionality coefficient determined by the structure and physical properties of the driving TFT DT, depending on the electron mobility of the driving TFT DT, channel width, channel length, etc. Vgs represents the voltage difference between the gate and source electrodes of the driving TFT DT, and Vth represents the threshold voltage of the driving TFT DT. 'Vgs-Vth' during the fourth period t4 is as expressed in the following equation:

$$Vgs - vth = \left[\frac{\mathrm{DATA} \times CA2 + CA1(Vth + Voledanode)}{CA1 + CA2} - Voledanode\right] - Vth \tag{5}$$

To sum up Equation 5, the drain-source current Ids of the driving TFT DT is derived as expressed in the following equation:

$$Vgs - Vth = \left[\frac{\mathrm{DATA} \times CA2}{CA1 + CA2} - \frac{CA2(Voledanode + Vth)}{CA1 + CA2}\right] \tag{6}$$

With reference to equation 6, "Vgs-Vth" depends on the capacitance CA1 of the first capacitor C1 and the capacitance CA2 of the second capacitor C2. The larger the capacitance CA1 of the first capacitor C1 is, the larger "CA1+CA2" of the equation 6 becomes, and the smaller "Vth" of the equation 6 becomes. In this case, "CA2(Voled_anode+Vth)/(CA1+CA2)" of the equation 6 becomes smaller, and thus the compensation capability of the threshold voltage Vth of the driving TFT DT becomes higher. Also, the larger the capacitance CA2 of the second capacitor C2 is, the larger "DATA×CA2" of the equation 6 becomes and the larger "DATA" of the equation 6 becomes. That is, the drain-source current Ids of the driving TFT DT becomes wider because the range of "DATA" becomes wider. Therefore, the range of the luminance of the organic light emitting diode OLED becomes wider. And thus, the range of the pixel luminance which a pixel P represents becomes wider. Finally, the larger the capacitance CA1 of the first capacitor C1 is, higher the compensation capability of the threshold voltage Vth of the driving TFT DT becomes. Also, the larger the capacitance CA2 of the second capacitor C2 is, wider the range of the pixel luminance becomes. The capacitance CA1 of the first capacitor C1 and the capacitance CA2 of the second capacitor C2 are designed in consideration of the compensation capability of the threshold value Vth and the range of the pixel luminance Fifth, during the fifth period t5, the scan signal SCAN having the gate low voltage VGL is supplied through the scan line SL, and the initialization signal INI having the gate low voltage VGL is supplied through the initialization line IL as shown in FIG. 3. Also, during the fourth period t5, the emission signal EM having the gate low voltage VGL is supplied through the emission line EML as shown in FIG. 3.

Figure 5E:
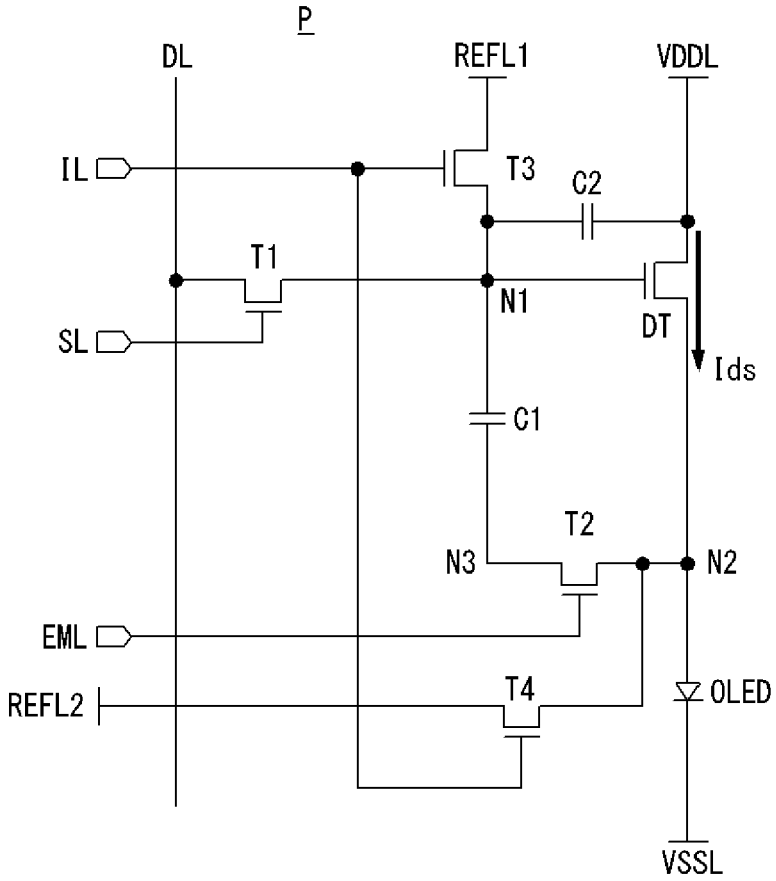

With reference to FIG. 5E, the first TFT T1 is turned off by the scan signal SCAN having the gate low voltage VGL. Therefore, the first node N1 is not coupled to the data line DL. The second TFT T2 is turned off by the emission signal EM having the gate low voltage VGL. Therefore, the second node N2 is no longer coupled to the third node N3. The third TFT T3 and the fourth TFT T4 are turned off by the initialization signal INI having the gate low voltage VGL. Therefore, each of the second node N2 and the third node N3 is not coupled to the second reference voltage line REF2. Finally, the drain-source current Ids of the driving TFT DT is retained as in equation 6 during the fifth period t5.

As described above, the pixel P according to the first exemplary embodiment is driven as a source follower method that senses the threshold voltage Vth of the driving TFT DT by using the second node N2 coupled to the source electrode of the driving TFT DT. By driving using a source follower method, the pixel P according to the first exemplary embodiment initializes the first node N1 to the first reference voltage REF1 and the second node N2 and the third node N3 to the second reference voltage REF2 during the first period t1. The second reference voltage REF2 is set to a voltage lower than a difference voltage between the first reference voltage REF1 and the threshold voltage Vth of the driving TFT DT. In this case, the first reference voltage REF1 and the second reference voltage REF2 may be designed based on the threshold voltage Vth of the driving TFT DT equal to or higher than 0V. As a result, the pixel P according to the first exemplary embodiment may sense the threshold voltage Vth of the driving TFT DT because a voltage difference Vgs between a gate node Ng and a source node Ns of the driving TFT DT can be controlled to be greater than the threshold voltage Vth even though the threshold voltage Vth is shifted to a negative voltage. A negative shift refers to shifting the threshold voltage Vth of the driving TFT DT to a voltage lower than 0 V when the driving TFT DT is implemented as an N-type MOSFET. The negative shift usually occurs when a semiconductor layer of the driving TFT DT is formed of an oxide.

Also, the pixel P according to the first exemplary embodiment compensates the threshold voltage Vth of the driving TFT DT by using the second node N2 and the third node N3 during the fourth period t4. "Voled_anode" that corresponds to the voltage of the second node N2 and the voltage of the third node N3 may include a variation of the threshold voltage Vth of the driving TFT DT because the second node N2 and the third node N3 are coupled to the organic light emitting diode OLED during the fourth period t4. Also, "Voled_anode" may include a variation of the low-potential voltage VSS which is caused by emitting the organic light emitting diode OLED. Therefore, the pixel P according to the first exemplary embodiment may compensate the variation of the threshold voltage Vth of the driving TFT DT and the variation of the low-potential voltage VSS.

Also, the pixel P according to the first exemplary embodiment may control the second period t2 that is a period of sensing the threshold voltage Vth of the driving TFT DT as several horizontal periods or dozens of horizontal periods. Therefore, the first exemplary embodiment may sense the threshold voltage Vth of the driving TFT DT accurately during the second period t2 even though the display panel is driven at high speed such as a frame frequency of 240 Hz or more.

Furthermore, according to the first exemplary embodiment, the high-potential voltage VDD may be dropped due to emission of the organic light emitting diode OLED by the drain-source current Ids of the driving TFT DT during the fourth and fifth periods t4, t5. However, the pixel P according to the first exemplary embodiment may be apply a voltage drop of the high-potential voltage VDD to the first node N1 when the second capacitor C2 is coupled between the first node N1 and the high-potential voltage line VDDL. Therefore, the pixel P according to the first exemplary embodiment may be compensate a voltage drop of the high-potential voltage VDD.

Figure 6:
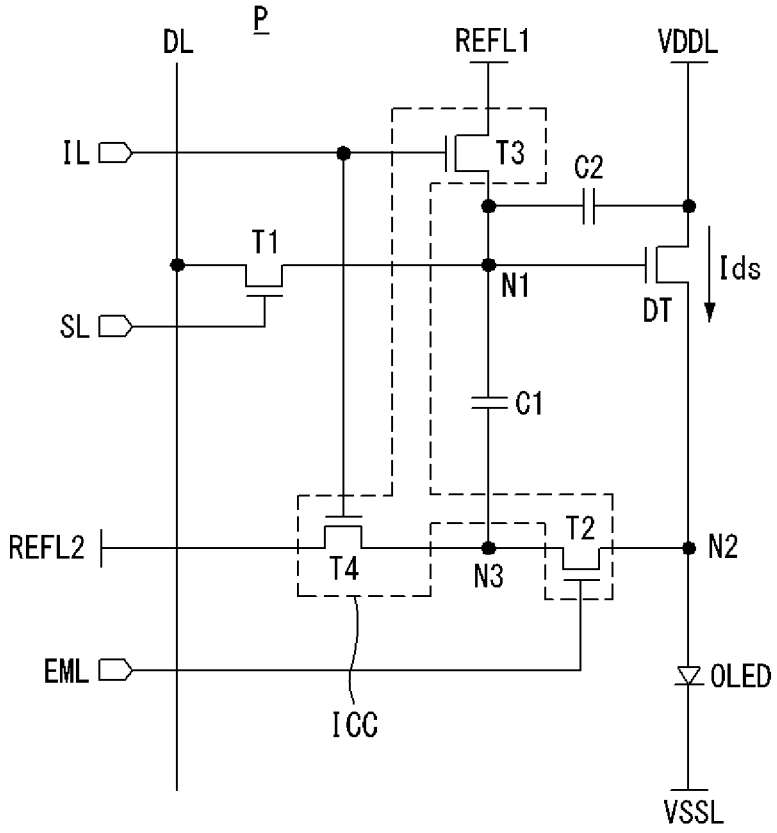
FIG. 6 is a circuit diagram of a pixel according to a second exemplary embodiment.

FIG. 6 is a circuit diagram of a pixel P according to a second exemplary embodiment. Referring to FIG. 6, the pixel P according to the second exemplary embodiment comprises a driving TFT DT, an organic light emitting diode OLED, a control circuit, and capacitors. The control circuit includes a first TFT T1, and an initialization control circuit ICC. The initialization control circuit ICC includes second to fourth TFT T2~T4. The capacitors include a first capacitor C1 and a second capacitor C2.

The pixel P according to the second exemplary embodiment is substantially same as the pixel P according to the first exemplary embodiment as shown in FIG. 2. Hence, descriptions of the driving TFT DT, the organic light emitting diode OLED, the first to third TFTs T1, T2, and T3, and the first and second capacitors C1, C2 will be omitted.

With reference to FIG. 6, the fourth TFT T4 is a second initialization TFT which initializes the third node N3 to a second reference voltage REF2 supplied through a second reference voltage line REFL2 in response to an initialization signal INI supplied through an initialization line IL. A gate electrode of the third TFT T4 is coupled to the initialization line IL, a source electrode thereof is coupled to the second reference voltage line REFL2, and a drain electrode thereof is the third node N3.

An initialization signal INI, a scan signal SCAN, an emission signal EM, and a data voltage DATA that are supplied to the pixel P according to the second exemplary is substantially same as described in FIG. 3. Also, voltage changes of the first to third nodes N1, N2, N3 will be described with reference to FIGS. 7, 8A to 8E.

FIG. 7 is a table showing changes in the voltages of nodes of a pixel according to a second exemplary embodiment of the present invention. FIGS. 8A to 8E are a circuit diagram of a pixel according to a second exemplary embodiment of the present invention during first to fifth periods. An operation method of the pixel P according to the second exemplary embodiment will be described in the below with reference to FIGS. 3, 7, and 8A to 8E.

First, during the first period t1, the scan signal SCAN having the gate low voltage VGL is supplied through the scan line SL, and the initialization signal INI having the gate high voltage VGH is supplied through the initialization line IL as shown in FIG. 3. Also, during the first period t1, the emission signal EM having the gate high voltage VGH is supplied through the emission line EML as shown in FIG. 3.

Figure 8A:
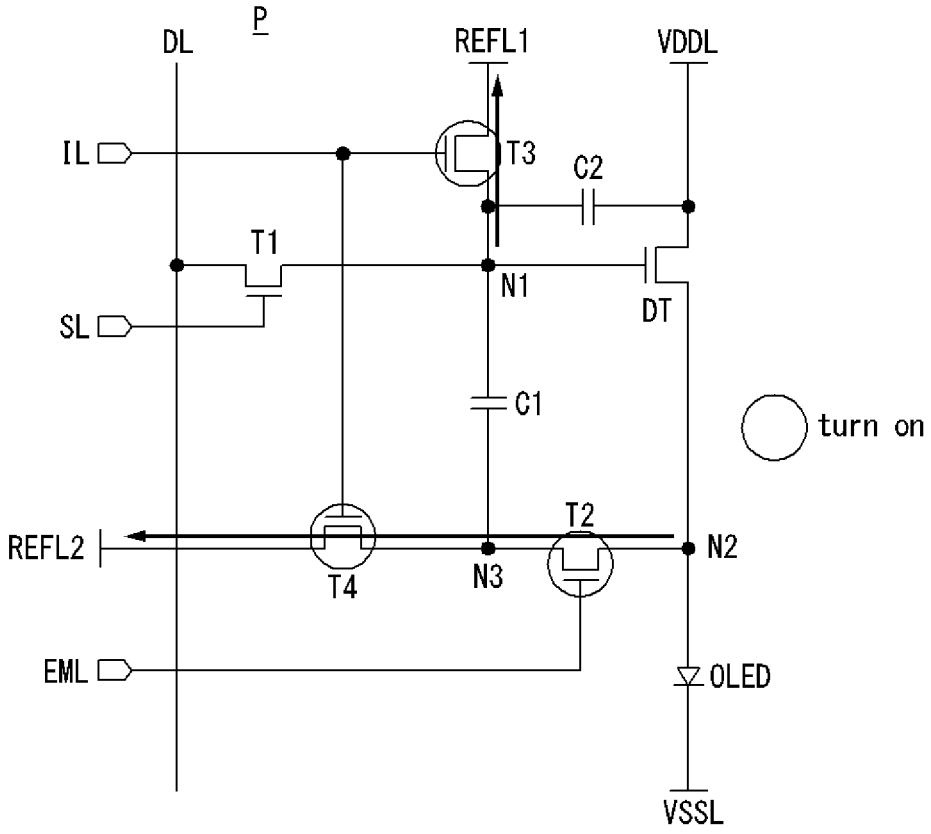
FIGS. 8A to 8E are circuit diagrams of a pixel according to a second exemplary embodiment during first to fifth periods.
Figure 8B:
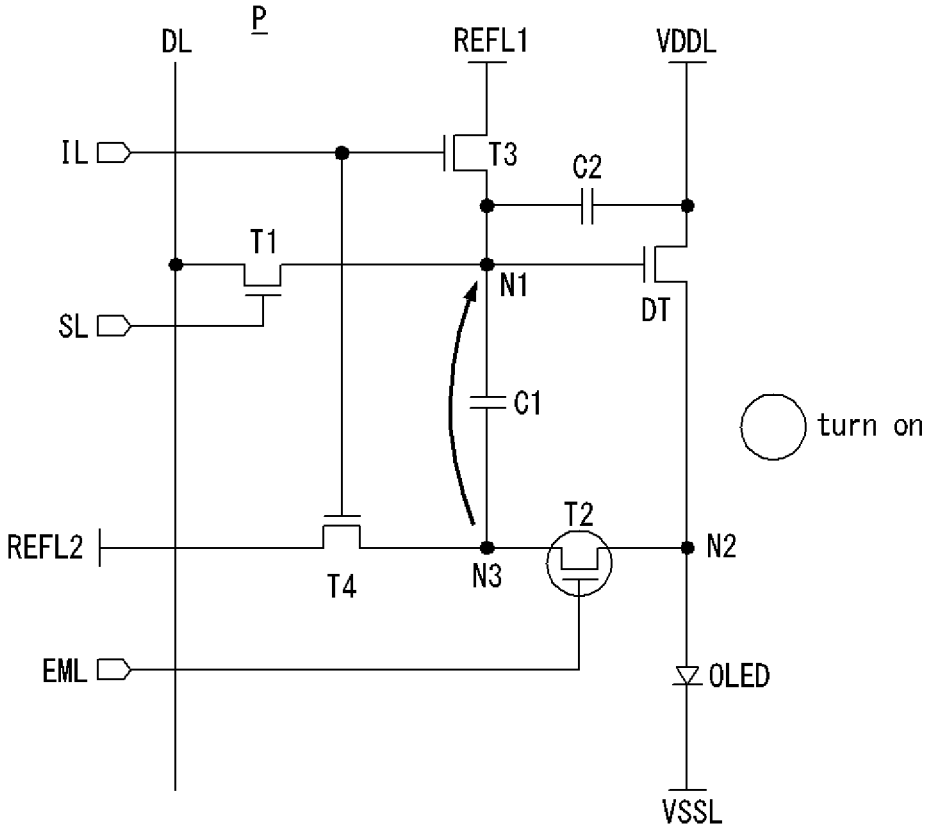
Figure 8C:
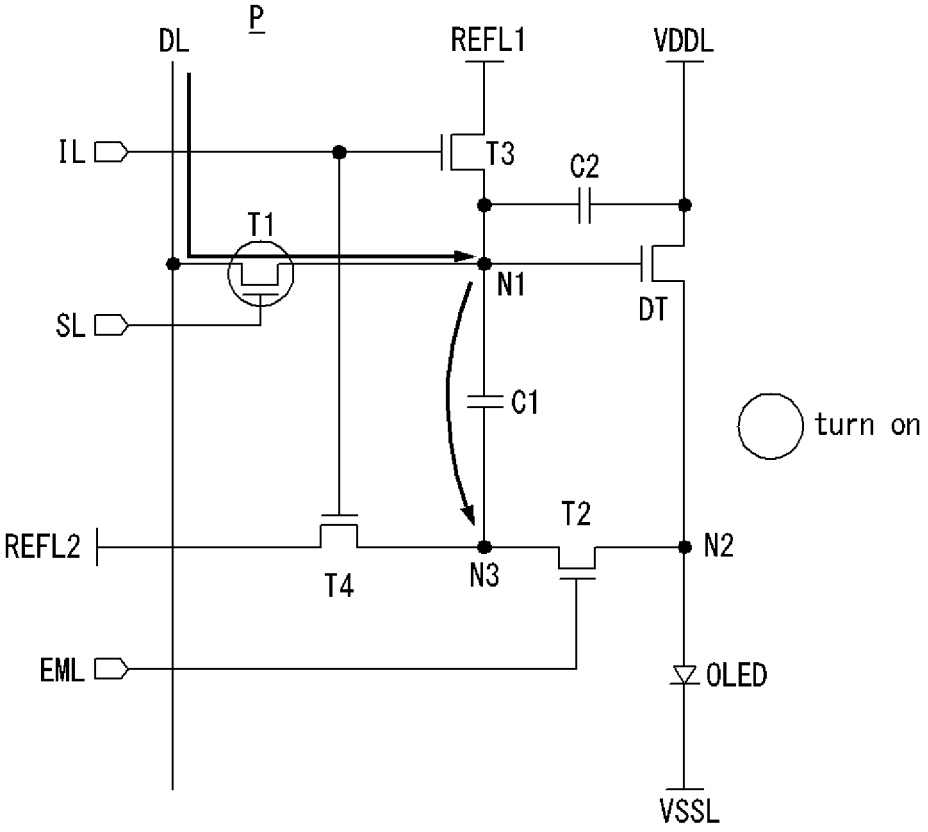
Figure 8D:
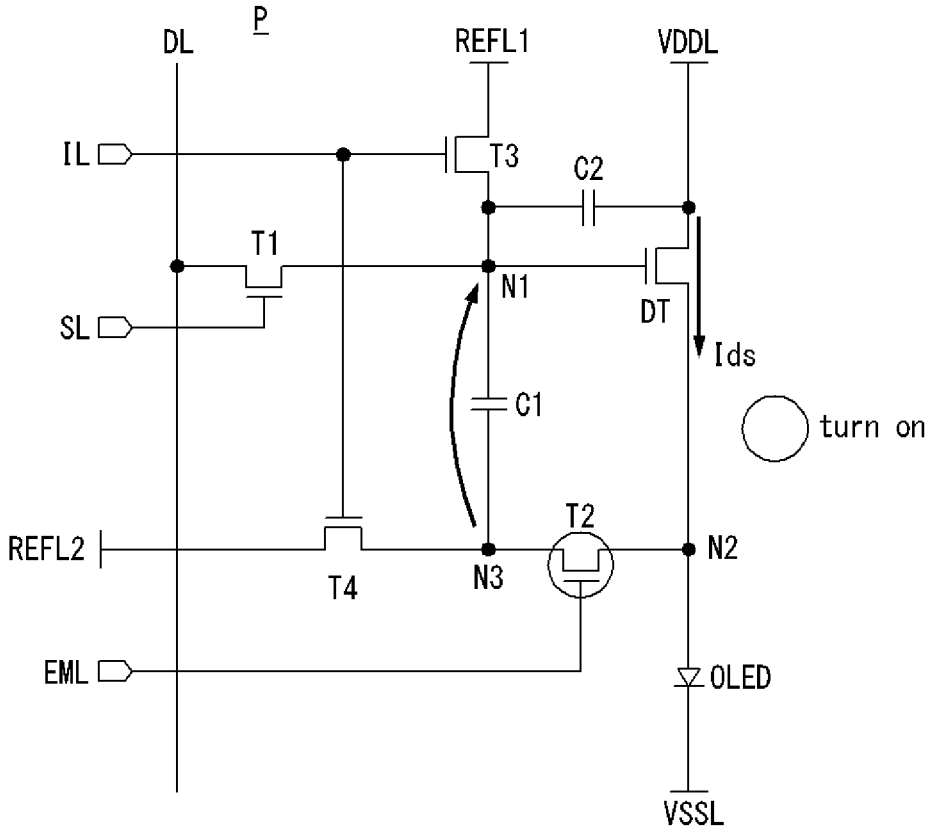
Figure 8E:
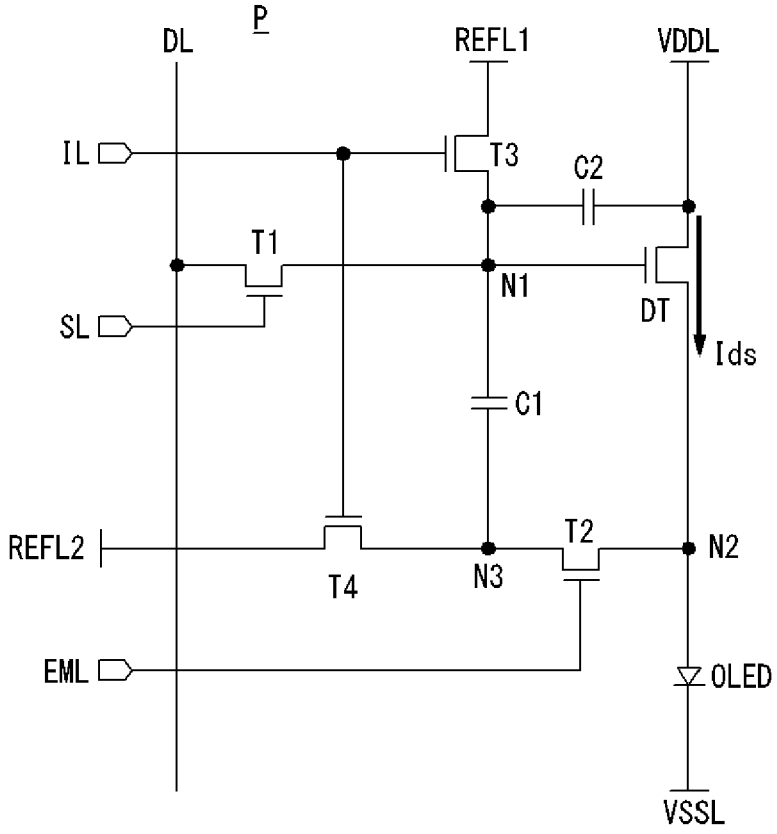

With reference to FIG. 8A, the first TFT T1 is turned off by the scan signal SCAN having the gate low voltage VGL. The second TFT T2 is turned on in response to the emission signal EM having the gate high voltage VGH. Therefore, the second node N2 is coupled to the third node N3. The third TFT T3 is turned on in response to the initialization signal INI having the gate high voltage VGH. Therefore, the first node N1 is coupled to the first reference voltage line REFL1. The fourth TFT T4 is turned on in response to the initialization signal INI having the gate high voltage VGH. Therefore, the third node N3 is coupled to the second reference voltage line REF2.

Finally, the voltage of the first node N1 is initialized to the first reference voltage REF1 since the third TFT T3 is turned on. The voltage of the second node N2 is initialized to the second reference voltage REF2 since the second TFT T2 is turned on. The voltage of the third node N3 is initialized to the second reference voltage REF2 since the fourth TFT T4 is turned on.

Meanwhile, the operation method of the pixel P according to the second exemplary embodiment is substantially same as the first exemplary embodiment described with reference to FIGS. 3, 4, and 5A to 5E. Therefore, the operation method of the pixel P according to the second exemplary embodiment during the second to fifth periods will be omitted.

Figure 9:
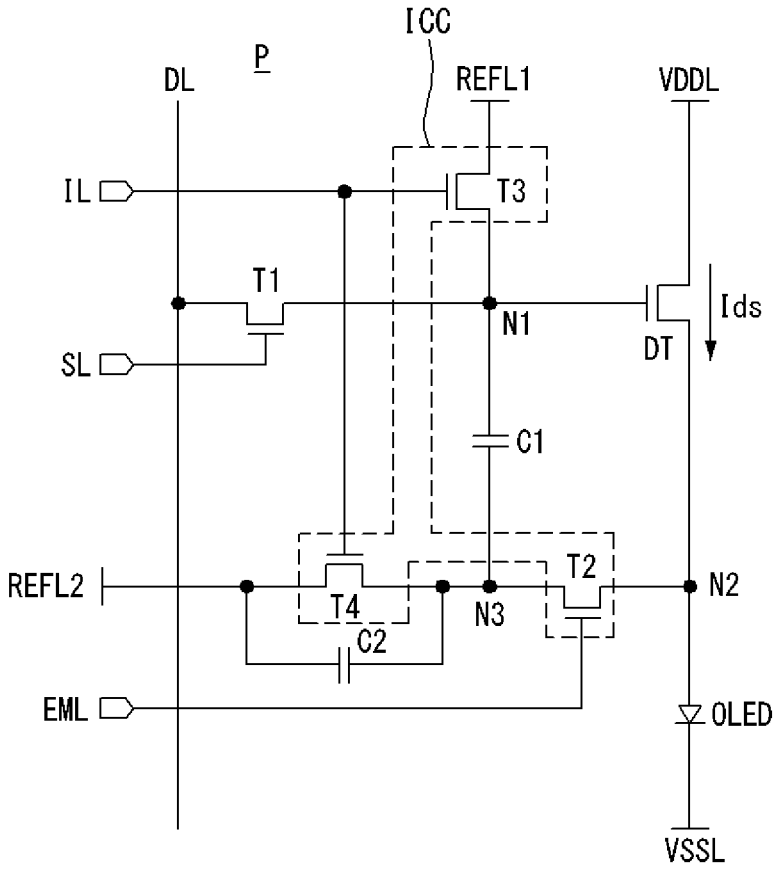
FIG. 9 is a circuit diagram of a pixel according to a third exemplary embodiment.

FIG. 9 is a circuit diagram of a pixel P according to a third exemplary embodiment. Referring to FIG. 9, the pixel P according to the third exemplary embodiment comprises a driving TFT DT, an organic light emitting diode OLED, a control circuit, and capacitors. The control circuit includes a first TFT T1 and an initialization control circuit ICC. The initialization control circuit ICC includes second to fourth TFT T2 through T4. The capacitors include a first capacitor C1 and a second capacitor C2.

The pixel P according to the second exemplary embodiment is substantially same as the pixel P according to the first exemplary embodiment as shown in FIG. 2. Hence, descriptions of the driving TFT DT, the organic light emitting diode OLED, the first to third TFTs T1, T2, and T3, and the first capacitor C1 will be omitted.

With reference to FIG. 9, the fourth TFT T4 is a second initialization TFT which initializes the third node N3 to a second reference voltage REF2 supplied through a second reference voltage line REFL2 in response to an initialization signal INI supplied through the initialization line IL. A gate electrode of the third TFT T4 is coupled to the initialization line IL, a source electrode thereof is coupled to the second reference voltage line REFL2, and a drain electrode thereof is the third node N3.

The second capacitor C2 is coupled between the third node N3 and the second reference voltage line REFL2. In this case, the second capacitor C2 stores a differential voltage between a voltage at the third node N3 and the second reference voltage REF2. Or, the second capacitor C2 may be coupled between the third node N3 and the first reference voltage line REFL1. In this case, the second capacitor C2 stores a differential voltage between a voltage at the third node N3 and the first reference voltage REF1. Alternatively, the second capacitor c2 is coupled between the third node N3 and the high-potential voltage line VDDL. In this case, the second capacitor C2 stores a differential voltage between a voltage at the third node N3 and the high-potential voltage VDD.

An initialization signal INI, a scan signal SCAN, an emission signal EM, and a data voltage DATA that are supplied to the pixel P according to the third exemplary is substantially same as described in FIG. 3. Also, voltage changes of the first to third nodes N1, N2, N3 will be described with reference to FIGS. 10, 11A to 11E.

FIG. 10 is a table showing changes in the voltages of nodes of a pixel according to a third exemplary embodiment. FIGS. 11A to 11E are a circuit diagram of a pixel according to a third exemplary embodiment of the present invention during first to fifth periods. An operation method of the pixel P according to the third exemplary embodiment will be described in the below with reference to FIGS. 3, 10, and 11A to 11E.

First, during the first period t1, the scan signal SCAN having the gate low voltage VGL is supplied through the scan line SL, and the initialization signal INI having the gate high voltage VGH is supplied through the initialization line IL as shown in FIG. 3. Also, during the first period t1, the emission signal EM having the gate high voltage VGH is supplied through the emission line EML as shown in FIG. 3.

Figure 11A:
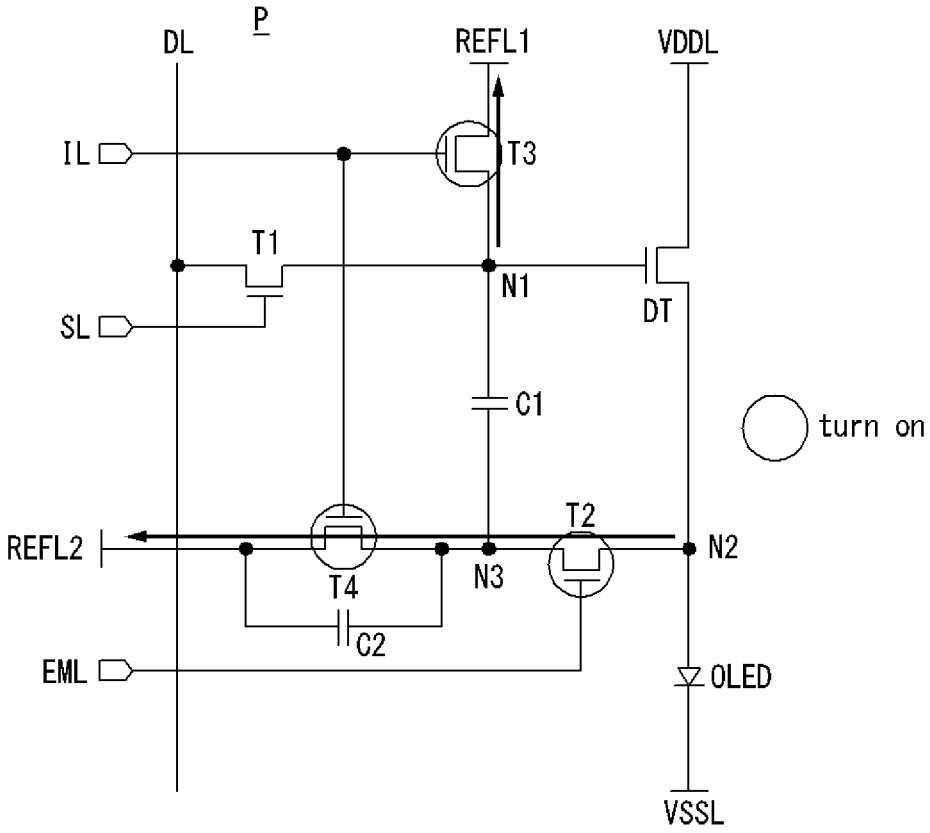
FIGS. 11A to 11E are circuit diagrams of a pixel according to a third exemplary embodiment of first to fifth periods.

With reference to FIG. 11A, the first TFT T1 is turned off by the scan signal SCAN having the gate low voltage VGL. The second TFT T2 is turned on in response to the emission signal EM having the gate high voltage VGH. Therefore, the second node N2 is coupled to the third node N3. The third TFT T3 is turned on in response to the initialization signal INI having the gate high voltage VGH. Therefore, the first node N1 is coupled to the first reference voltage line REFL1. The fourth TFT T4 is turned on in response to the initialization signal INI having the gate high voltage VGH. Therefore, the third node N3 is coupled to the second reference voltage line REF2.

Finally, the voltage of the first node N1 is initialized to the first reference voltage REF1 since the third TFT T3 is turned on. The voltage of the second node N2 is initialized to the second reference voltage REF2 since the second TFT T2 is turned on. The voltage of the third node N3 is initialized to the second reference voltage REF2 since the fourth TFT T4 is turned on.

Second, during the second period t2, the scan signal SCAN having the gate low voltage VGL is supplied through the scan line SL, and the initialization signal INI having the gate low voltage VGL is supplied through the initialization line IL as shown in FIG. 3. Also, during the second period t2, the emission signal EM having the gate high voltage VGH is supplied through the emission line EML as shown in FIG. 3.

Figure 11B:
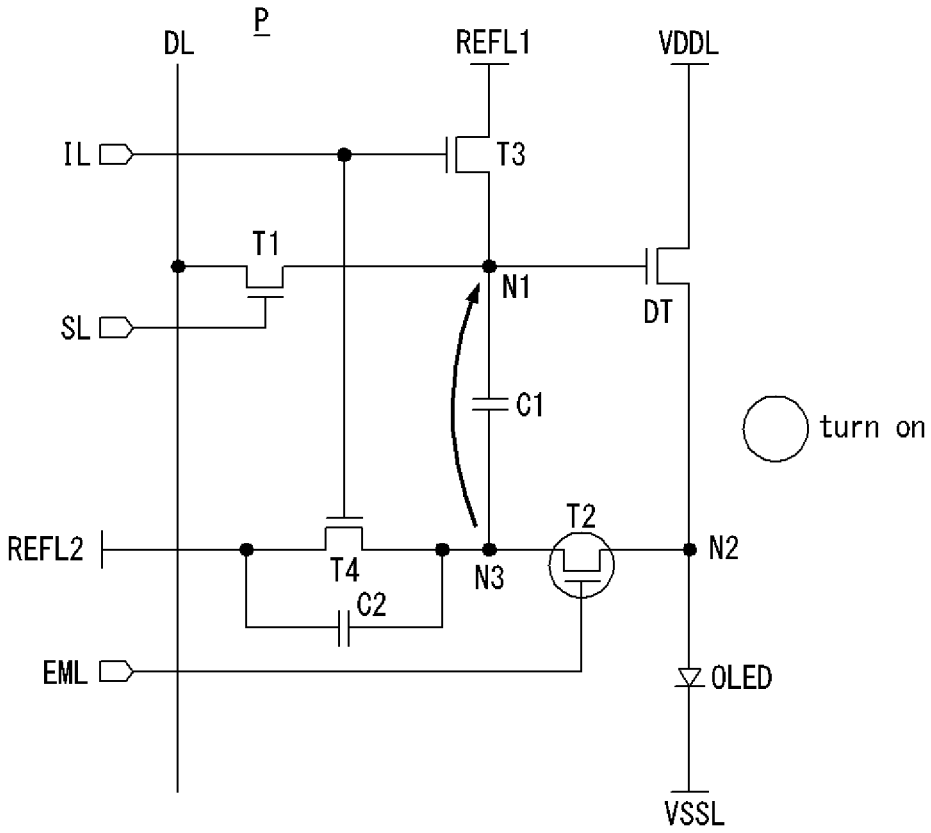

With reference to FIG. 11B, the first TFT T1 is turned off by the scan signal SCAN having the gate low voltage VGL. The second TFT T2 is turned on in response to the emission signal EM having the gate high voltage VGH. Therefore, the second node N2 is coupled to the third node N3. The third TFT T3 and the fourth TFT T4 are turned off by the initialization signal INI having the gate low voltage VGL. Therefore, each of the second node N2 and the third node N3 is no longer coupled to the second reference voltage line REF2. Meanwhile, the second node N2 and the third node N3 have substantially the same potential since the second TFT T2 is turned on.

Because the voltage difference Vgs between the gate and source electrodes of the driving TFT DT is greater than the threshold voltage Vth, the driving TFT DT forms a current path until the voltage difference Vgs between the gate and source electrodes reaches the threshold voltage Vth. Accordingly, the voltage of the second node N2 rises up. Also, the voltage of the third node N3 rises up since the second node N2 is coupled to the third node N3. Meanwhile, the voltage change of the third node N3 is applied to the first node N1 by the cap boosting of the first capacitor C1. If the voltage of the first node N1 which the voltage change of the third node N3 is applied to is "A" voltage, the voltage of the second node N2 rises up to a differential voltage A−Vth between the voltage A of the first node N1 and the threshold voltage Vth of the driving TFT DT. Also, the voltage of the third node N3 rises up to a differential voltage A−Vth between the voltage A of the first node N1 and the threshold voltage Vth of the driving TFT DT since the second node N2 is coupled to the third node N3. "A" voltage may be "REF1+α". Finally, the threshold voltage Vth of the driving TFT DT may be stored to the first capacitor C1 during the second period t2.

Third, during the third period t3, the scan signal SCAN having the gate high voltage VGH is supplied through the scan line SL, and the initialization signal INI having the gate low voltage VGL is supplied through the initialization line IL as shown in FIG. 3. Also, during the third period t3, the emission signal EM having the gate low voltage VGL is supplied through the emission line EML as shown in FIG. 3.

Figure 11C:
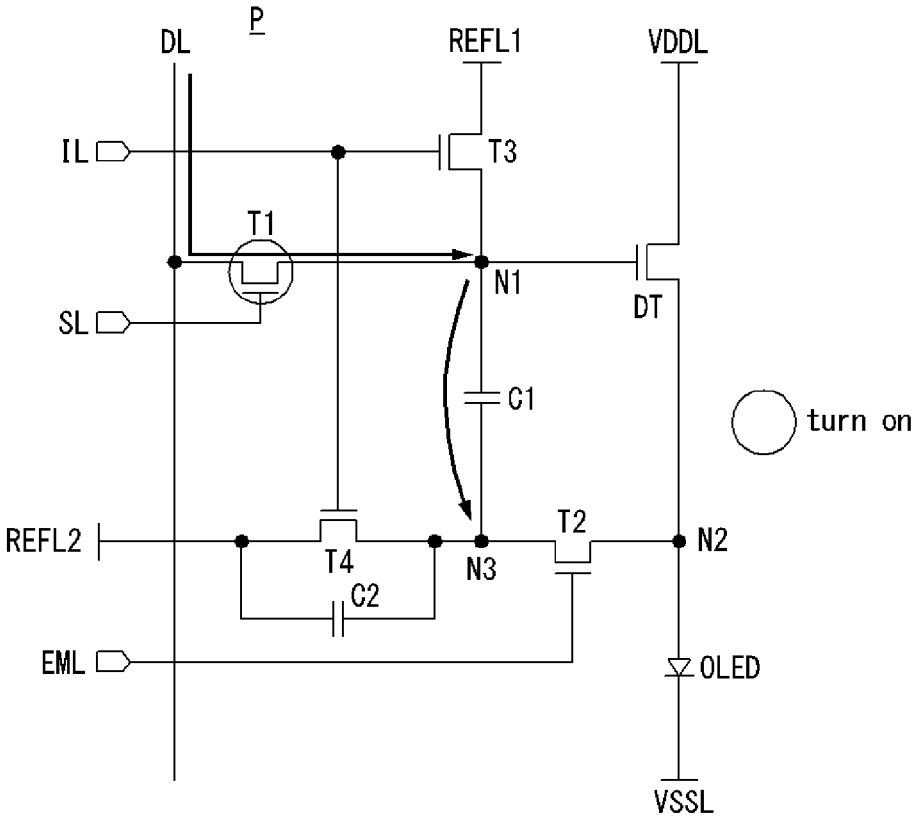

With reference to FIG. 11C, the first TFT T1 is turned on in response to the scan signal SCAN having the gate high voltage VGH. Therefore, the first node N1 is coupled to the data line DL. The second TFT T2 is turned off by the emission signal EM having the gate low voltage VGL. Therefore, the second node N2 is no longer coupled to the third node N3. The third TFT T3 and the fourth TFT T4 are turned off by the initialization signal INI having the gate low voltage VGL. Therefore, each of the second node N2 and the third node N3 is not coupled to the second reference voltage line REF2. Meanwhile, the data voltage DATA of the data line is supplied to the first node N1 since the first TFT T1 is turned on. The third node N3 is on the floating state since the second TFT T2 is turned off. The floating state refers to a state on which no voltage is supplied to a node, so the node on the floating state affects voltage change of an adjacent node easily.

The voltage change of the first node N1 is applied to the third node N3 since the third node N3 is on the floating state during the third period t3. "A−DATA" corresponding to the voltage change of the first node N1 is applied to the third node N3. However, the third node N3 is coupled between the first and second capacitors CA1 and CA2 coupled in series. Hence, the voltage change is applied in the ratio "C'" as expressed in the equation 2. Therefore, "C'(A-DATA)" is applied to the third node, and the voltage of the third node N3 is changed to "A−Vth-C'(A−DATA)".

Fourth, during the fourth period t4, the scan signal SCAN having the gate low voltage VGL is supplied through the scan line SL, and the initialization signal INI having the gate low voltage VGL is supplied through the initialization line IL as shown in FIG. 3. Also, during the fourth period t4, the emission signal EM having the gate high voltage VGH is supplied through the emission line EML as shown in FIG. 3.

Figure 11D:
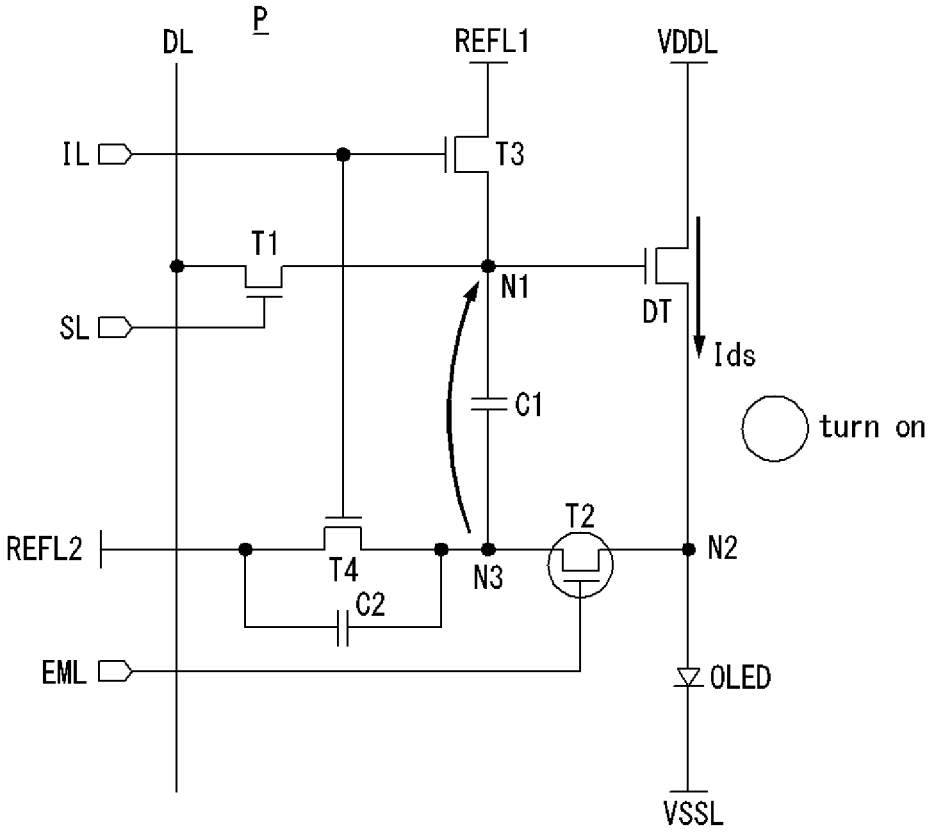

With reference to FIG. 11D, the first TFT T1 is turned off by the scan signal SCAN having the gate low voltage VGL. Therefore, the first node N1 is no longer coupled to the data line DL. The second TFT T2 is turned on in response to the emission signal EM having the gate high voltage VGH. Therefore, the second node N2 is coupled to the third node N3. The third TFT T3 and the fourth TFT T4 are turned off by the initialization signal INI having the gate low voltage VGL. Therefore, each of the second node N2 and the third node N3 is not coupled to the second reference voltage line REF2. Meanwhile, the first node N1 is on the floating state since the first TFT T1 and the third TFT T3 are turned off. The second node N2 and the third node N3 are at substantially the same potential since the second TFT T2 is turned on.

The voltage of the second node N2 is changed to "Voled_anode" due to the drain-source current Ids of the driving TFT DT according to the voltage of the first node N1. Also, the voltage of the third node N3 is changed to "Voled_anode" because the second node N2 is coupled to the third node N3 since the second TFT T2 is turned on.

The voltage change of the third node N3 is applied to the first node N1 by the first capacitor C1 because the first node N1 is on the floating state during the fourth period t4. Therefore, the voltage change of the third node N3, "{A−Vth−C'(A−DATA)}−Voled_anode" is applied to the first node N1. As a consequence, the voltage of the first node N1 is changed to "DATA−{A−Vth−C'(A−DATA)−Voled_anode}".

The changed voltage of the first node N1 is expressed in following equation:

$$Vgv-Vth=[\text{DATA}-(A-Vth-CAA-\text{DATA})-\text{Voledanode})-\text{Voledanode}]-Vth \quad (7)$$

To sum up Equation 7, the drain-source current Ids of the driving TFT DT is derived as expressed in the following equation:

$$I_{ds}=k'[(1-C')\cdot(\text{DATA}-A)]^2 \quad (8)$$

With reference to equation 8, the drain-source current Ids does not depend on the threshold voltage Vth of the driving TFT DT during the fourth period t4. That is, the threshold voltage Vth of the driving TFT DT may be compensated.

Fifth, during the fifth period t5, the scan signal SCAN having the gate low voltage VGL is supplied through the scan line SL, and the initialization signal INI having the gate low voltage VGL is supplied through the initialization line IL as shown in FIG. 3. Also, during the fourth period t5, the emission signal EM having the gate low voltage VGL is supplied through the emission line EML as shown in FIG. 3.

Figure 11E:
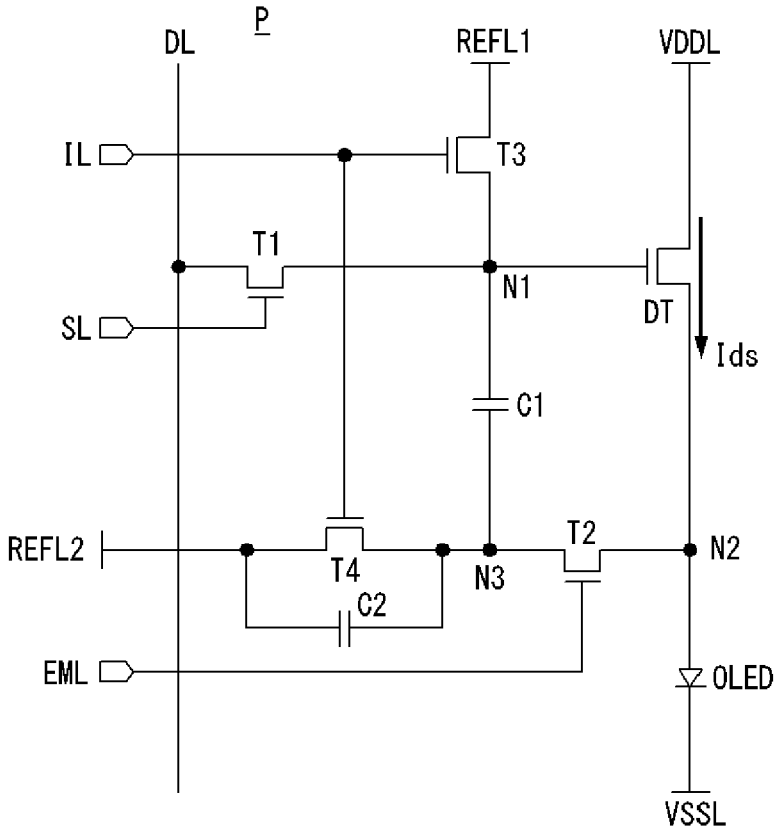

With reference to FIG. 11E, the first TFT T1 is turned off by the scan signal SCAN having the gate low voltage VGL. Therefore, the first node N1 is not coupled to the data line DL. The second TFT T2 is turned off by the emission signal EM having the gate low voltage VGL. Therefore, the second node N2 is no longer coupled to the third node N3. The third TFT T3 and the fourth TFT T4 are turned off by the initialization signal INI having the gate low voltage VGL. Therefore, each of the second node N2 and the third node N3 is not coupled to the second reference voltage line REF2. Finally, the drain-source current Ids of the driving TFT DT is retained as in equation 8 during the fifth period t5.

As described above, the pixel P according to the third exemplary embodiment is driven as a source follower method that senses the threshold voltage Vth of the driving TFT DT by using the second node N2 coupled to the source electrode of the driving TFT DT. By driving using the source follower method, the pixel P according to the third exemplary embodiment initializes the first node N1 to the first reference voltage REF1 and the second node N2 and the third node N3 to the second reference voltage REF2 during the first period t1. The second reference voltage REF2 is set to a voltage lower than a difference voltage between the first reference voltage REF1 and the threshold voltage Vth of the driving TFT DT. In this case, the first reference voltage REF1 and the second reference voltage REF2 may be designed based on the threshold voltage Vth of the driving TFT DT equal to or higher than 0V. As a result, the pixel P according to the third exemplary embodiment may sense the threshold voltage Vth of the driving TFT DT because a voltage difference Vgs between a gate node Ng and a source node Ns of the driving TFT DT can be controlled greater than the threshold voltage Vth even though the threshold voltage Vth is shifted to a negative voltage. A negative shift refers to shifting the threshold voltage Vth of the driving TFT DT to a voltage lower than 0 V when the driving TFT DT is implemented as an N-type MOSFET. The negative shift usually occurs when a semiconductor layer of the driving TFT DT is formed of an oxide.

Also, as can be noted in Equation (8), the drain-source current Ids of the driving TFT DT does not depend upon the threshold voltage Vth of the driving TFT DT. Hence, compared to the embodiments of FIGS. 2 and 6, the compensation of the threshold voltage can be performed more enhanced in the embodiment of FIG. 9.

Also, the pixel P according to the third exemplary embodiment compensates the threshold voltage Vth of the driving TFT DT by using the second node N2 and the third node N3 during the fourth period t4. "Voled_anode" that corresponds to the voltage of the second node N2 and the voltage of the third node N3 during the fourth period t4 may include a variation of the threshold voltage Vth of the driving TFT DT because the second node N2 and the third node N3 are coupled to the organic light emitting diode OLED during the fourth period t4. Also, "Voled_anode" may include a variation of the low-potential voltage VSS which is caused by emitting the organic light emitting diode OLED. Therefore, the pixel P according to the first exemplary embodiment may compensate the variation of the threshold voltage Vth of the driving TFT DT and the variation of the low-potential voltage VSS.

Furthermore, the pixel P according to the third exemplary embodiment may control the second period t2 that is a period of sensing the threshold voltage Vth of the driving TFT DT as several horizontal periods or dozens of horizontal periods. Therefore, the third exemplary embodiment may sense the threshold voltage Vth of the driving TFT DT accurately during the second period t2 even though the display panel is driven at high speed such as a frame frequency of 240 Hz or more.

Figure 12:
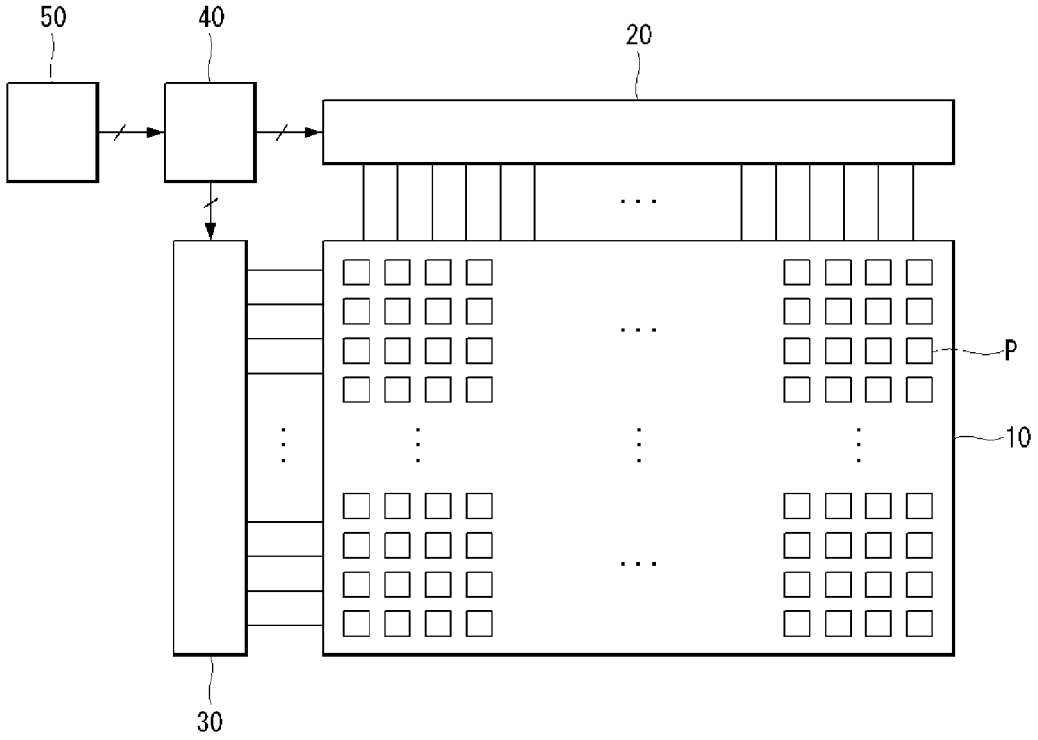
FIG. 12 is a block diagram schematically showing an organic light emitting diode display device according to an exemplary embodiment.

FIG. 12 is a block diagram schematically showing an organic light emitting diode display device according to an exemplary embodiment. Referring to FIG. 12, the organic light emitting diode display device according to the exemplary embodiment comprises a display panel 10, a data driver 20, a scan driver 30, a timing controller 40, and a host system 50.

Data lines DL and scan lines SL crossing each other are formed on the display panel 10. Initialization lines IL and emission lines EML may be formed in parallel with the scan lines SL on the display panel 10. Also, pixels P are arranged in a matrix form on the display panel 10. Each of the pixels P of the display panel 10 is as described in conjunction with FIG. 2, FIG. 6, and FIG. 9.

The data driver 20 comprises a plurality of source drive ICs. The source drive ICs receive digital video data RGB from the timing controller 40. The source drive ICs convert the digital video data RGB into a gamma compensation voltage in response to a source timing control signal DCS from the timing controller 40 to generate data voltages and supply the data voltages to the data lines DL of the display panel 10 in synchronization with scan signals SCAN.

The scan driver 30 comprises a scan signal output part, an initialization signal output part, and an emission signal output part. The scan signal output part sequentially outputs the scan signals SCAN to the scan lines SL of the display panel 10. The initialization signal output part sequentially outputs initialization signals to the initialization lines IL. The emission signal output part sequentially outputs emission signals EM to the emission lines EML of the display panel 10. Detailed descriptions of the scan signal SCAN, the initialization signal INI, and the emission signal EM will be described in detail in conjunction with FIG. 3.

The timing controller 40 receives digital video data RGB from the host system 50 through a low voltage differential signaling (LVDS) interface, a transition minimized differential signaling (TMDS) interface, etc. The timing controller 40 receives timing signals such as a vertical synchronization signal, a horizontal synchronization signal, a data enable signal, and a dot clock, and generates timing control signals for controlling operation timings of the data driver 20 and scan driver 30 based on the timing signals from the host system 50. The timing control signals comprise a scan timing control signal for controlling the operation timing of the scan driver 30 and a data timing control signal for controlling the operation timing of the data driver 20. The timing controller 40 outputs the scan timing control signal to the scan driver 30, and outputs the data timing control signal and the digital video data RGB to the data driver 20.

The display panel 10 may further comprise a power supply unit (not shown). The power supply unit supplies a high-potential voltage VDD, a low-potential voltage VSS, a first reference voltage REF1, and a second reference voltage REF2 to the display panel 10. Further, the power supply unit supplies a gate high voltage VGH and a gate low voltage VGL to the scan driver 30.

The embodiments described herein are driven using a source follower that senses the threshold voltage Vth of the driving TFT DT by using the second node N2 coupled to the source electrode of the driving TFT DT. By driving as the source follower, the embodiments described herein initialize the first node N1 to the first reference voltage REF1 and the second node N2, and the third node N3 to the second reference voltage REF2 during the first period t1 (i.e., an initialization period). The second reference voltage REF2 is set to a voltage lower than a difference voltage between the first reference voltage REF1 and the threshold voltage Vth of the driving TFT DT. As a result, the embodiments described herein may sense the threshold voltage Vth of the driving TFT DT because a voltage difference Vgs between a gate node Ng and a source node Ns of the driving TFT DT can be controlled to be greater than the threshold voltage Vth even though the threshold voltage Vth is shifted to a negative voltage.

Also, the embodiments described herein compensate the threshold voltage Vth of the driving TFT DT by using the second node N2 and the third node N3 during the fourth period t4. "Voled_anode" that corresponds to the voltage of the second node N2 and the voltage of the third node N3 may include a variation of the threshold voltage Vth of the driving TFT DT because the second node N2 and the third node N3 are coupled to the organic light emitting diode OLED during the fourth period t4. Also, "Voled_anode" may include a variation of the low-potential voltage VSS which is caused by emitting the organic light emitting diode OLED. Therefore, the embodiments described herein may compensate the variation of the threshold voltage Vth of the driving TFT DT and the variation of the low-potential voltage VSS.

Also, the embodiments described herein may extend the second period t2 corresponding to a period of sensing the threshold voltage Vth of the driving TFT DT to several horizontal periods or dozens of horizontal periods. Therefore, the embodiments described herein may sense the threshold voltage Vth of the driving TFT DT more accurately during the second period t2 even though the display panel is driven at a high speed (e.g., a frame frequency of 240 Hz or more).

Furthermore, according to the first exemplary embodiment, the high-potential voltage VDD may be dropped due to emission of the organic light emitting diode OLED by the drain-source current Ids of the driving TFT DT during the fourth and fifth periods t4, t5. However, the pixel P according to the first exemplary embodiment may apply a voltage drop of the high-potential voltage VDD to the first node N1 when the second capacitor C2 is coupled between the first node N1 and the high-potential voltage line VDDL. Therefore, the pixel P according to the first exemplary embodiment may compensate a voltage drop of the high-potential voltage VDD.

Although the embodiments of this application have been described with reference to a number of illustrative embodiments thereof, it should be understood that numerous other modifications and embodiments of this application can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An organic light emitting diode display device comprising a plurality of pixels arranged in a matrix form, each of the pixels comprising:

a driving thin film transistor (TFT) including a gate electrode coupled to a first node, a source electrode coupled to a second node, and a drain electrode coupled to a high-potential voltage line;

an organic light emitting diode between the second node and a low-potential voltage line;

a first TFT configured to connect a data line to the first node during a data voltage supply period of a frame period;

an initialization control circuit coupled between the first node and a first reference voltage line supplying a first reference voltage, the initialization control circuit further connected to a second node, a third node and a second reference voltage line supplying a second reference voltage, the initialization control circuit configured to initialize the first node to the first reference voltage, and the second and third nodes to a second reference voltage during an initialization period of the frame period preceding the data voltage supply period, and configured to initialize the second and third nodes to a second reference voltage during the initialization period; and a first capacitor coupled between the first node and the third node, the first capacitor configured to store a voltage difference between the first node and the third node during the initialization period, and change a voltage level of the first node based on a voltage level of the third node in a threshold voltage sensing period between the initialization period and the data voltage supply period, wherein the initialization control circuit includes:

a second TFT including gate electrode coupled to an emission line, a source electrode coupled to the third node, and a drain electrode coupled to the second node;

a third TFT including a gate electrode coupled to an initialization line for carrying an initialization signal to indicate the initialization period, a source electrode coupled to the first reference voltage, and a drain coupled to the first node;

a fourth TFT including a gate electrode coupled to the initialization line, a source electrode coupled to the second reference voltage line, and a drain electrode coupled to the second node or third node, the third TFT and fourth TFT receiving the initialization signal simultaneously.

2. The organic light emitting diode display device of claim 1, wherein the initialization control circuit is further configured to disconnect the second node and the third node to float the third node during the data voltage supply period.

3. The organic light emitting diode display device of claim 1, wherein each of the pixels further comprises a second capacitor coupled between the first node and the first reference voltage line or the high-potential voltage line.

4. The organic light emitting diode display device of claim 1, wherein each of the pixels further comprises a second capacitor coupled between the first node and the second reference voltage line supplying the second reference voltage.

5. The organic light emitting diode display device of claim 1, wherein the first TFT comprises a gate electrode coupled to a scan line, a source electrode coupled to the first node, and a drain electrode coupled to the second node.

6. The organic light emitting diode display device of claim 1, wherein the second reference voltage is lower than a voltage difference between the first reference voltage and a threshold voltage of the driving TFT.

7. The organic light emitting diode display device of claim 1, wherein the initialization period is indicated by an initialization signal transmitted by an initialization line coupled to the initialization control circuit, wherein starting of an emission period subsequent to the data voltage supply period is indicated by an emission signal transmitted by an emission line coupled to the initialization control circuit.

8. The organic light emitting diode display device of claim 1, wherein the threshold voltage sensing period corresponds to more than one horizontal period.

9. A method of operating a pixel of an organic light emitting diode display device, comprising:

initializing a first node to a first reference voltage by turning on a first thin film transistor (TFT) of an initialization control circuit responsive to receiving an initialization signal via an initialization line during an initialization period, the first node coupled to a gate electrode of a driving TFT;

initializing second and third nodes to a second reference voltage by turning on a second TFT of the initialization control circuit simultaneously with the first TFT of the initialization control circuit responsive to receiving the initialization signal via the initialization line during the initialization period, the second node coupled to a source electrode of the driving TFT, and a first capacitor coupled between the first node and a third node;

storing a voltage difference between the first node and the third node during the initialization period by the first capacitor;

changing a voltage level of the first node based on a voltage level of the third node in a threshold voltage by applying the voltage difference in the first capacitor in a threshold voltage sensing period subsequent to the initialization period;

connecting a data line to the first node by a third TFT during a data voltage supply period subsequent to the threshold voltage sensing period; and controlling current through an organic light emitting diode (OLED) by turning on a fourth TFT of the initialization control circuit to apply voltage at the first node to the gate electrode of the driving TFT responsive to receiving an emission signal at a gate of the fourth TFT during an emission period subsequent to the data voltage supply period.

10. The method of claim 9, further comprising disconnecting the second node and the third node to float the third node during the data voltage supply period.

11. The method of claim 9, further comprising coupling a second capacitor between the first node and a high-potential voltage line or a first reference voltage line supplying the first reference voltage.

12. The method of claim 9, further comprising coupling a second capacitor between the third node and a second reference voltage line supplying the second reference voltage.

13. The method of claim 9, further comprising receiving a scan signal indicating a data voltage supply period at a gate electrode of the first TFT.

14. The method of claim 9, wherein the second reference voltage is lower than a voltage difference between the first reference voltage and a threshold voltage of the driving TFT.

15. The method of claim 9, wherein the threshold voltage sensing period corresponds to more than one horizontal period.

* * * * *